US007757988B2

(12) United States Patent
Pallmann et al.

(10) Patent No.: US 7,757,988 B2
(45) Date of Patent: Jul. 20, 2010

(54) DEVICE FOR THE PROCESSING OF FEEDSTOCK WITH A ROTOR-STATOR SYSTEM

(75) Inventors: Hartmut Pallmann, Zweibrücken (DE); Jochen Heib, Saarbruecken (DE)

(73) Assignee: Pallmann Maschinenfabrik GmbH & Co. KG, Zweibruecken (DE)

( * ) Notice: Subject to any disclaimer, the term of this patent is extended or adjusted under 35 U.S.C. 154(b) by 92 days.

(21) Appl. No.: 11/987,423

(22) Filed: Nov. 29, 2007

(65) Prior Publication Data

US 2008/0135658 A1 Jun. 12, 2008

(30) Foreign Application Priority Data

Nov. 29, 2006 (DE) ..... 10 2006 056 542

(51) Int. Cl.
*B02C 18/18* (2006.01)

(52) U.S. Cl. ..... 241/243; 241/286

(58) Field of Classification Search ..... 241/286, 241/242, 243
See application file for complete search history.

(56) References Cited

U.S. PATENT DOCUMENTS 4,295,616 A * 10/1981 Hill ..... 241/241
2003/0222163 A1 12/2003 Plahuta et al.

FOREIGN PATENT DOCUMENTS

DE 20009718 U1 8/2000
DE 202005013719 U1 3/2006

* cited by examiner

*Primary Examiner*—Mark Rosenbaum
(74) *Attorney, Agent, or Firm*—Muncy, Geissler, Olds & Lowe, PLLC

(57) ABSTRACT

A device for processing feedstock is provided that includes a rotor rotating around an axis in a housing, which houses processing tools, and has stator tools that are stationary with respect to the housing, which, by maintaining a working clearance, the rotor side processing tools are arranged opposite to the stator tools and interact with the stator tools to process the feedstock. The device also includes a resetting device for displacing the stator tools in a radial direction to set the working clearance. The resetting device for the stator tools include at least one tilted support surface, which directly or indirectly forms a contact surface for the stator tools. Whereby, the support surface is slideable with respect to the stator tools in order to adjust the working clearance.

21 Claims, 8 Drawing Sheets

DEVICE FOR THE PROCESSING OF FEEDSTOCK WITH A ROTOR-STATOR SYSTEM

This nonprovisional application claims priority under 35 U.S.C. §119(a) to German Patent Application No. DE 102006056542, which was filed in Germany on Nov. 29, 2006, and which is herein incorporated by reference.

BACKGROUND OF THE INVENTION

1. Field of the Invention

The present invention relates to a device for processing feedstock.

2. Description of the Background Art

Conventional devices are used for the crushing of feedstock and/or with feedstock composed of various components, which may also be in compounds, for the separation of the components from one another, to be recovered as reusable materials for new production processes. An example of the feedstock in question is the collection of reusable materials obtained from the disposal of household waste, whereby there are large amounts of plastics mixed with sheet metal. Similarly, there is a device according to the present invention for the processing of electrical and electronic scrap, such as vacuum cleaners, telephone sets, computers, kitchen utensils, etc., whose constituent components are plastic and metal. Other applications consist of the processing of cable scrap made of plastic-coated copper or aluminum wires or in the reprocessing of old tires that are made of rubber, steel and fabric or in the processing of recycled wood, which is often contaminated with impurities, for example, with hardware.

A basic objective in processing feedstock is to separate the fundamental components existing in the feedstock in order to carry out the subsequent processing steps. In most cases, this also involves a crushing of at least one of the components of the feedstock. Independently, a device according to the invention may also be used to crush the feedstock exclusively, for example that exists in a pure or unmixed form.

The principal construction design of a generic device envisages a rotor-stator system. This rotor is fitted with processing tools around its circumference that are directed in a line of rotation to the stationary stator tools and interacts with them. Depending on the type of processing tools, the feedstock is thus subjected to a cutting, shearing, deformation, beating, chopping, or breaking process.

Depending upon the mechanical properties of the feedstock, particularly its hardness, tensile strength and silicate percentage, this means that during the processing step the processing tools are subjected to relatively strong wear, which leads to an increasing degree to a deterioration of the processing results and to an increasing degree of power consumption. The reason for this is the enlargement of a working clearance between the processing tools caused by deterioration which is countered from time to time by a radial resetting to restore the stator tools to the conventional clearance between rotor tools and stator tools. However, this is only possible to a certain extent, so that, at regular time intervals, the processing tools must be changed, for example, by having the effective edges reground or replaced.

Since both the resetting as well as the change of the processing tools considerably disturbs the operating procedure and the latter actually requires a shutdown, an effort is always being made to find an economical procedure to make the time required for resetting or changing tools as short as possible.

A granulator is known from the German patent DE 20 2005 013 719 U1 that has a rotor fitted with cutting tools to which a stationary counter blade is attached by a clamp to the stator side of the housing. A radial resetting of the counter blade due to deterioration takes place after the clamp is lifted and the radial set screws have been actuated. Since the counter blades extend along the entire length of the stator and thus often consist of several rows of single blades, aligning all the counter blades by actuating the individual clamping and set screws involves a great amount of time and effort. This leads to an undesirably long operating interruption, which adds up over time to a serious economic disadvantage.

In addition, a pair of guillotine shears is known from the German patent DE 200 09 718 U1, which corresponds to U.S. Pat. No. 6,983,904, and which has a pivotably mounted and driven rotor, on whose surface area a plurality of chipper knives are arranged. Counter blades in knife holders are fitted on the stator side, which are positioned around the swivel axes that are axially parallel to the rotary axis. Two diametrically opposed counter blades are attached to one of the knife holders, which may be moved by swiveling the knife holder into the cutting position with its interchangeable head and fastened. In this manner, a downtime determined by knife change is limited only to the duration of the swiveling procedure of the knife holder. By contrast, the replacement of the used counter knife can take place during the crushing operation. In addition, German patent DE 200 09 718U1 discloses a device for the setting of the cutting clearance in which the width of the cutting clearance is set by a small swiveling movement of the knife holder. However, this type of cutting clearance setting means that the spatial position of the counter blade not only changes in the radial direction, but also in the vertical direction, deviating overall from an optimal cutting geometry.

SUMMARY OF THE INVENTION

It is therefore an object of the present invention to provide a device in which the stator tools can be radially set and changed with the least possible interference of the operating procedure.

An aspect of the invention is to be able to carry out the resetting and changing of stator tools in the least amount of time. In an embodiment, the stator tools are to arranged with the interposition off a tilted setup surface that is radially slideable directly or indirectly via a knife holder. By means of a relative displacement of the setup surface with respect to the stator tools, the stator tools glide onto the setup surface, which produces a lifting or lowering of the stator tools with respect to the setup surface. The invention uses this lifting and lowering movement to radially reset the stator tools, both for the setting of the width of the working space as well as for the changing of the stator tools.

In an embodiment, a relative displacement of the setup surface with respect to the stator tools inside the housing is performed, because this allows a very fast adjustment of the stator tools. Further, the invention comprises embodiments that provide an adjustment of the stator tools to a certain protrusion outside the housing.

The invention comprises all types of relative displacement between the stator tools and the setup surface. Thus, it is possible to prepare the setup surface of the peripheral area of a rotating disk or roller that is arranged off-center to its axis of rotation. Likewise, the setup surface may be formed from a flat or curved area that is tangentially or slid in parallel to the rotation axis of the rotor. According to the invention, all types of relative displacement lead to a transformation of the sliding movement into a radial movement of the stator tool with respect to the rotor axis.

An axially directed sliding movement of the setup surface is preferred for the invention, for which corresponding linear guides may be provided within the device. In this manner, a relatively greater sliding movement may be realized, which makes it possible to construct the setup surfaces with relatively less tilt, making a sensitive radial setting of the stator tools with high precision possible.

In an embodiment of the invention, the setup surface of the wedge surface can be formed from a wedge component, whereby the basis of the wedge component is positioned in a guide enabled by the relative displacement. In addition to the possibility of providing a single long wedge component along the stator tools, an embodiment includes two or more consecutive wedge components in an axial direction, which, as a result of the setup surface achieved, permits a compact construction of a device according to the invention.

Where the arrangement of several wedge components is concerned, it is advantageous to arrange them on a joint base plate, which inevitably produces a synchronization of the relative displacement of the individual wedge components.

A worm gear or rack and pinion drive is provided as a drive in a further embodiment of the invention, to which a reduction gear is connected in series. These drives thus permit a sensitive control of the relative displacement, which can be carried out manually as well as by means of a motor.

In a further embodiment of the invention, to decouple the setting mechanism from the strong forces acting on the stator tools in operation, a clamping device to anchor the stator tools to the stator is provided. The clamping device can include two clamping bars running along both longitudinal sides of the stator tools of which one or both can be pressed by means of tensioning wedges on the stator tools. Such a tensioning device can be quickly clamped or released and thus contributes to a further reduction of the shutdown times due to tool changes.

In addition, the combination of individual components in a subassembly or package is preferred. This subassembly or package may belong with the components of the resetting device, in order to be able to remove the entire subassembly from the housing or to insert it with only an ejecting movement. The time to change the processing tools is thus further shortened. This embodiment of the invention is advantageously used when adjusting the stator tools to a certain protrusion outside the housing.

A mechanical ejection of the subassembly or package from the housing also works in this sense, for which a continuation of the linear guide outside the housing is provided according to a an embodiment of the invention. In this manner, the individual subassemblies are mechanically backed out through openings in the front side of the housing, where, because of accessibility attained by this means, they can be easily, safely and quickly removed and replaced by new ones.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
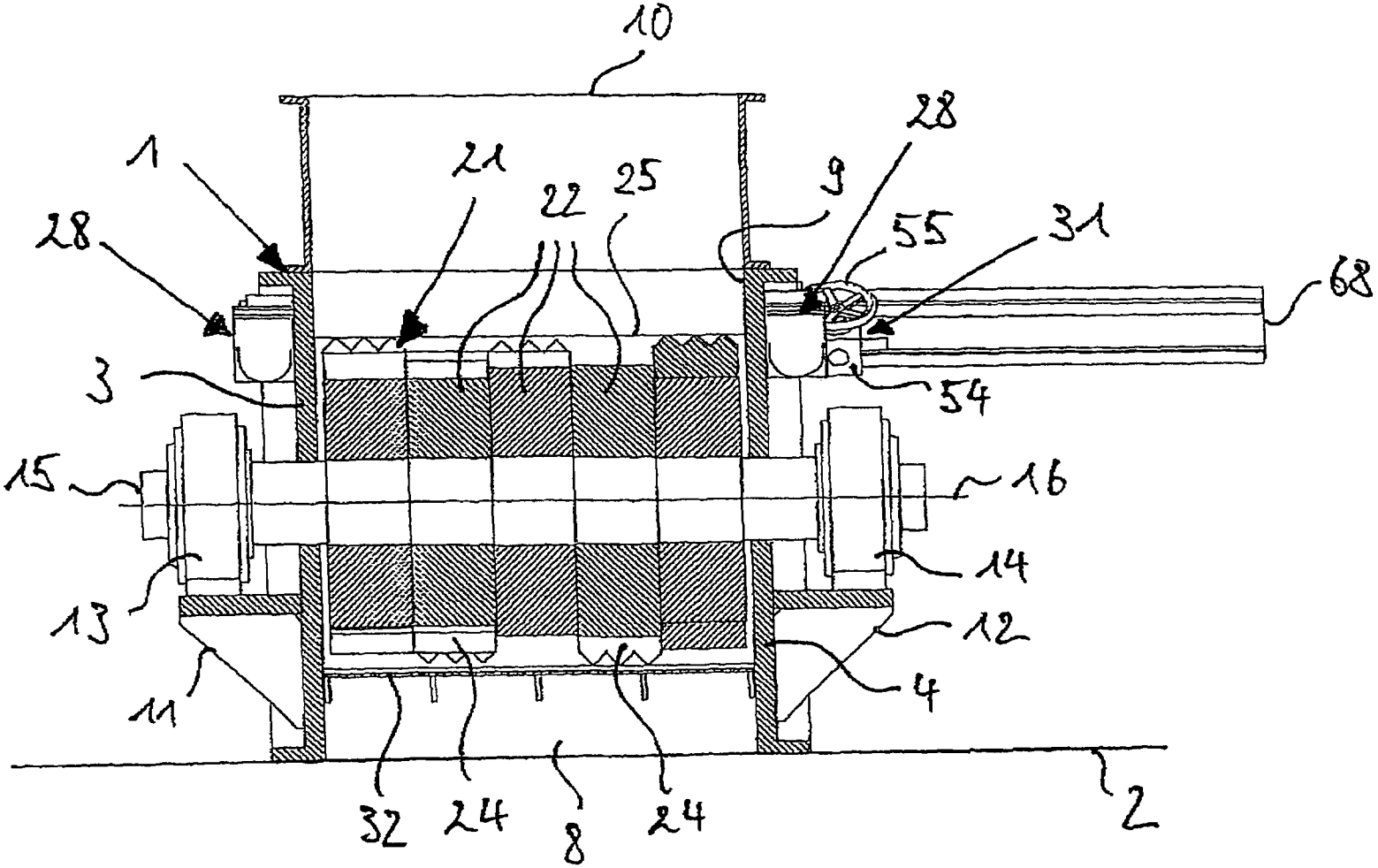
FIG. 1 illustrates a longitudinal section through a device according to the invention along the line 1-1 illustrated in FIG. 2.
Figure 2:
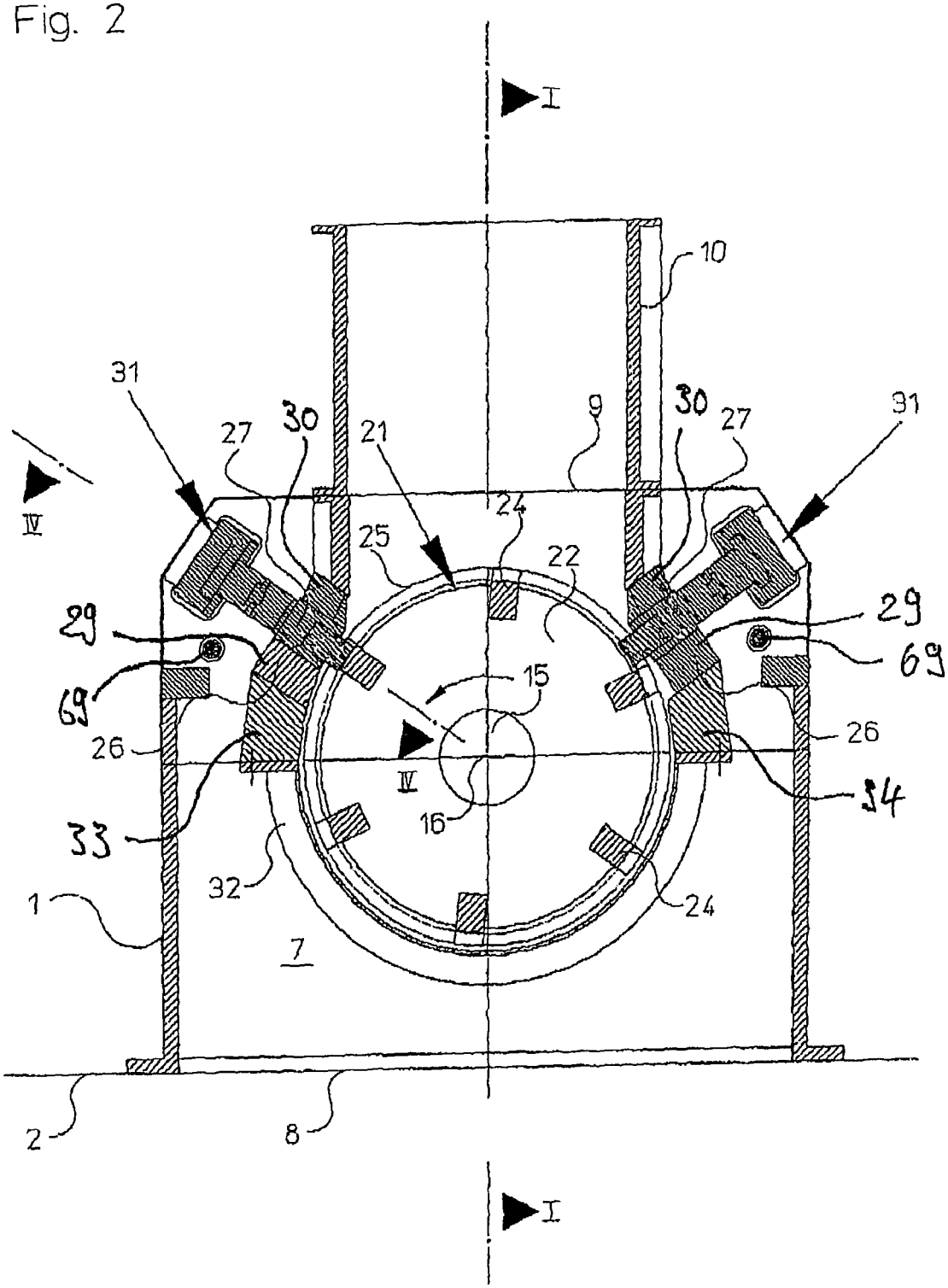
FIG. 2 illustrates a cross-section through the device illustrated in FIG. 1 along the Line II-II.
Figure 3:
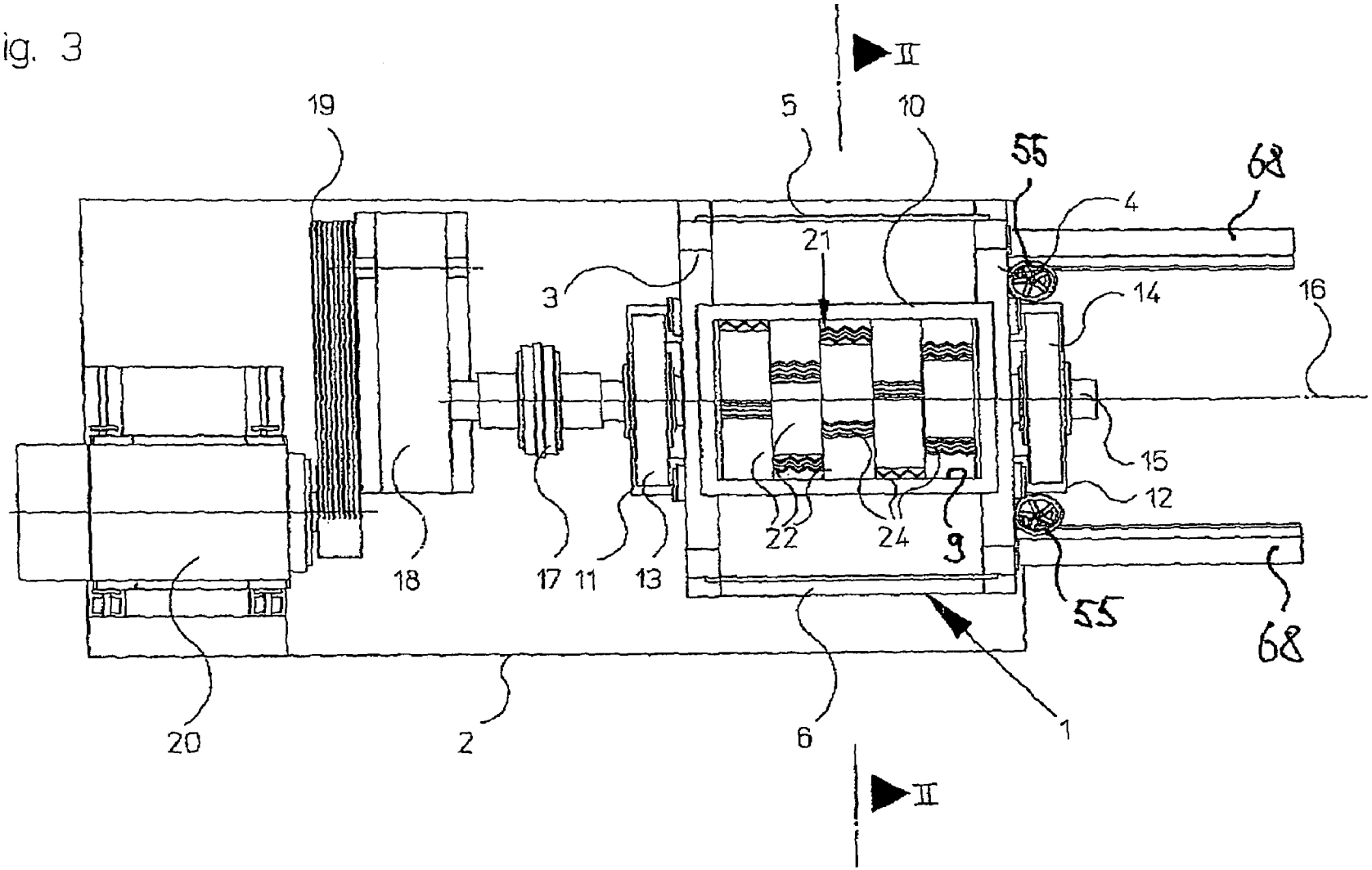
FIG. 3 illustrates a top view of the device illustrated in FIGS. 1 and 2.

The sections illustrated in FIGS. 1 to 3 provide an overview of the device according to the invention. The invention initially comprises a housing 1 in a somewhat rectangular shape, which rests on a frame construction, indicated with 2. The housing has two opposing front sides 3 and 4, which together with the connecting lateral sides 5 and 6 enclose a workroom 7. Below, housing 1 is open through a material outlet for the material hauloff. Above, housing 1 is closed, which has a central rectangular-shaped opening 9 extending along the entire length of housing 1, and this opening 9 is connected to a vertical, duct-shaped material outlet 10 that is flush with the opening 9.

To the outside of each of the front sides 3 and 4, a console 11 and 12 is centrally welded, which is used to house the horizontal pivot bearings 13 and 14. A horizontal drive shaft 15 is positioned in bearings 13 and 14, which extends through openings in the front sides 3 and 4 over the entire length of housing 1 and beyond and whose longitudinal axis forms the rotation axis. Via a coupling 17, a gear box 18 and V-belt 19, one end of the drive shaft 15 is connected with a drive 20 in the form of an electric motor.

Within housing 1, a horizontally arranged rotor 21 can be seen, which is built torque proof on the rotor plates 22 sitting on drive shaft 15. Each of the rotor plates 22 uniformly has distributed processing tools 24 on their periphery, which are constructed of shearing blades in the present example. All processing tools of rotor 21 delineate a uniform circumferential circle 25 during the rotation around axis 16.

In the peripheral area of rotor 21 underneath material outlet 10, stator tools 26 can be seen extending over the entire length of rotor 21, which, by maintaining a small working clearance 35 (FIG. 4), are radially opposite to processing tools 24. Stator tools 26 have a complementary profile to processing tools 24 of rotor 21 and interact with them.

Stator tools 26 are arranged in trough-shaped knife holders extending from front side 3 to front side 4, which are clamped rigidly opposite housing 1 in clamping devices 28. Each clamping device 28 is constructed of two laterally offset, axially parallel clamping bars 29 and 30 that centrally houses knife holder 27. At the same time, bar 29 is rigidly connected with front sides 3 and 4, while the opposite clamp 30 can be pressed via a tensioning wedge against knife holder 27, which is individually more closely described in the description for FIG. 6.

Each stator tool 26 and each tool holder 27 is arranged radially toward the outside of the connecting resetting device 31. Resetting device 31 is used for the setting and the resetting of stator tool 26 due to deterioration and to ensure the compliance of the predetermined width of working space 35 to the rotor side processing tools 24. The precise construction and operation of resetting device 31 is more closely described below FIGS. 4 and 5.

The lower circumferential section of rotor 21 lying between stator tools 26 is masked by a half-cylinder screen component whose longitudinal edges provided with flanges to longitudinal bearings 33 and 34 are detachably fastened. The sufficiently processed feedstock leaves the processing area via the screen surface of the screen component 32.

Figure 4:
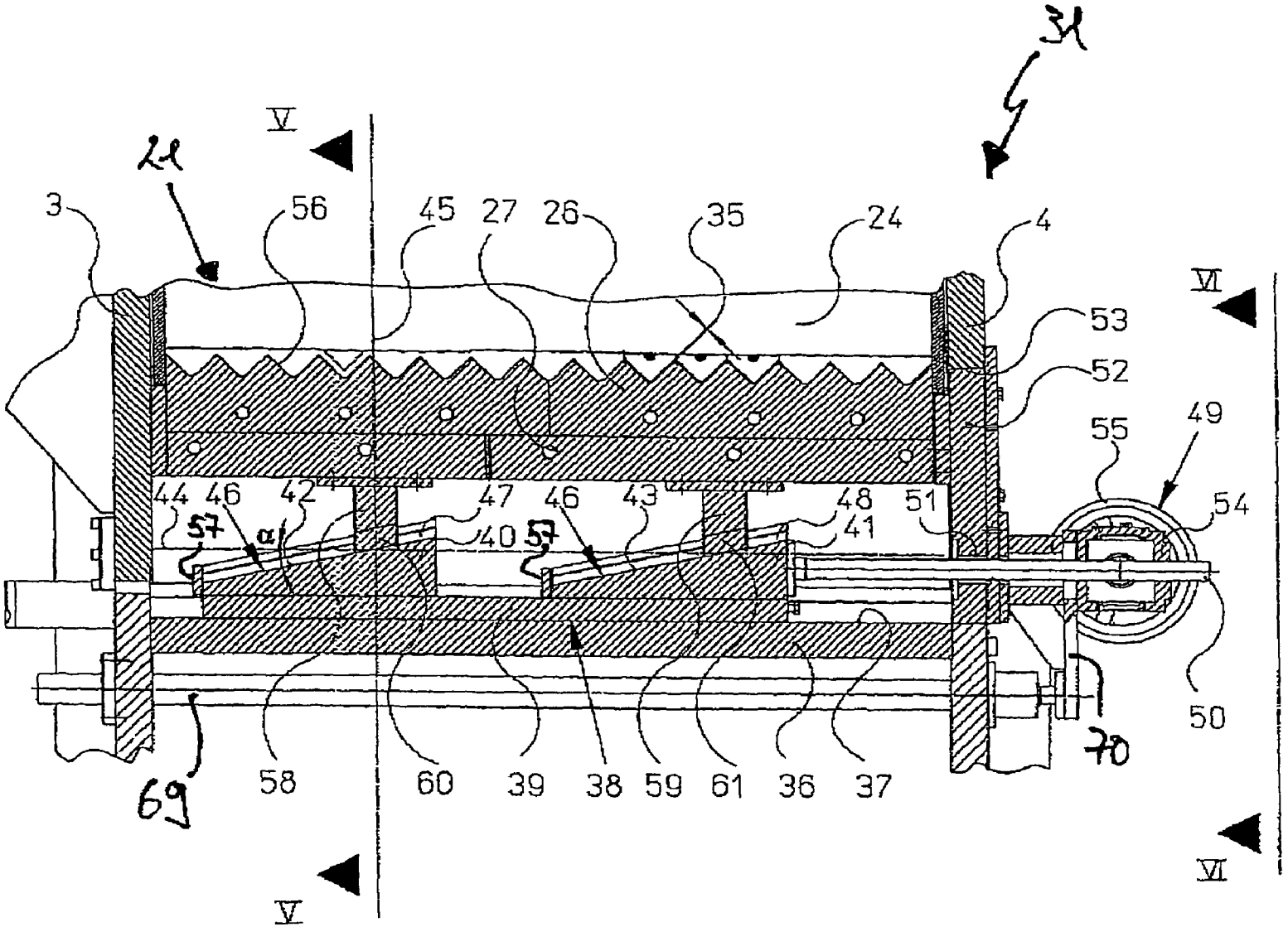
FIG. 4 illustrates a longitudinal section in the area of the stator tools along the Line IV-IV illustrated in FIG. 2.
Figure 5:
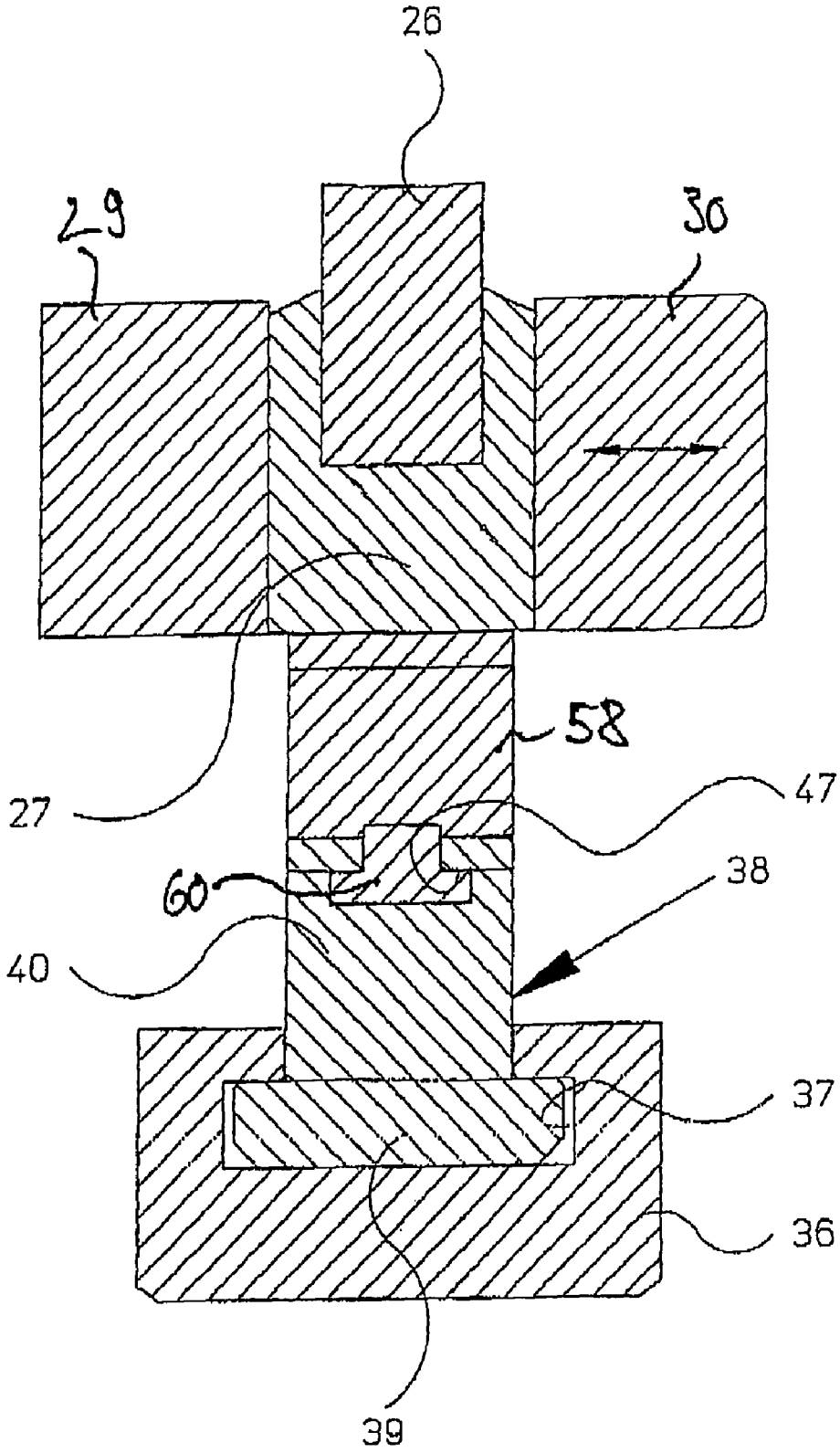
FIG. 5 illustrates a cross-section in the area of the stator tools along the Line V-V illustrated in FIG. 4.

In order to set the width of clearance 35, it is necessary to radially displace the stator tools 26 fastened in knife holder 27, which is carried out with resetting device illustrated in FIGS. 4 and 5. A corresponding cutout of front sides 3 and 4 can be seen in FIG. 4, between which a linear guide 36 running axially parallel to rotation axis 16 is rigidly attached. The side of linear guide bearing 36 turned toward rotor 21 has an encompassing slot 37, producing a C-shaped cross-section profile of linear guide 36. Linear guide bearing 35 forms a track for a slide 38.

Slide 38 is composed of a base plate 39, which corresponds in the cross-section to the profile of slot 37. Base plate 39 is clearly shorter than the opposite clearance of front sides 3 and 4, which produces a sliding motion in the axial direction. Base plate 39 is otherwise held on all sides in longitudinal guide 36, thus also against tilting or lifting.

In addition, slide 38 comprises two wedges 40 and 41, which in the free area between the encompassing longitudinal edges of linear guide 36 with axial clearance to each other, respectively flush with the end of base plate 39 and rigidly attached to it. Wedge surfaces 42 and 43 of wedges 40 and 41 running in the axial direction comprise a tilt angle $\alpha$ with a vertical plane 44 to a radial line 45 running out from rotation axis 16 through wedge surface 42. Both wedge surfaces 42 and 43 run plane parallel to each other and jointly form the setup surface 46 for the resetting of stator tool 26. For this purpose, wedge surfaces 42, 43 respectively have a longitudinal slot 47, 48, that corresponds to base plate 39's encompassing longitudinal edges for housing of the complementary formed knife holder 27. At the lower end of longitudinal slots 47, 48 a stop 57 limits the sliding movement for knife holder 27.

A drive 49 provides the movement of slide 38 within linear guide 36. Drive 49 comprises a push pull rod 50, whose end is rigidly connected to the rear side of wedge 41 and which extends with its other end axially parallel through an opening 51 in an insert 52, which is inserted in the respective area in a larger opening 53 of front side 4 where it forms front side 4.

A drive 54 is fastened to the outside of insert 52 in the area of opening 51 that is in contact with push pull rod 50. By actuation of the handwheel 55, the rotation movement in drive 54 is transformed into an axial movement of push pull rod 50 and thus slide 38 and setup 46 are transformed.

In addition, FIG. 4 shows the trough-shaped knife holder 27, in which stator tools 26 are solidly housed that runs axially parallel to the rotation axis 16 between front sides 3 and 4. Radially active edges 56 of stator tools 26 turned inwardly toward the interior of rotor 21 can be seen, which, by maintaining a narrow working clearance 35, the simply indicated processing tools 24 of rotor 21 lie radially opposite. On the underside of the trough-shaped knife holder 27 of rotor 21, supports 58 and 59 protrude, whose support area 60, 61 is formed with the tilting of wedge surfaces 42, 43 corresponding to the tilted setup surface and otherwise complementary to longitudinal slots 47, 48. In this manner, a longitudinal slideability of the support areas 60, 61 into the longitudinal slots 47, 48 is provided. Although they are not illustrated, there are embodiments that are also within the scope of the invention, in which the processing tools are supported directly by resetting device 31 and reset without intermediate connection.

For a guide in the radial direction, knife holder 27 is held between the interior of front sides 3 and 4, to which they are loosely connected. In addition, both bars 29 and 30 that are axially parallel to the rotation axis 16 form further guide surfaces as part of clamping device 28. In the open position of clamping device 28, knife holder 27 thus lies loosely between clamping bars 29 and 30, permitting a radial displacement of stator tools 26.

The radial displacement is produced by actuating handwheel 55, initiating an axial displacement of the push pull rod 50 and thus wedges 40 and 41 and, furthermore, setup surface 46. However, knife holder 27 is prevented from making an axial movement by front sides 3 and 4. Instead, a relative movement takes place between setup surface 46 and knife holder 27, in which supporting areas 60, 61 slide into the longitudinal slots. As a result of the tilting of support service 46, this leads to a lifting or lowering of knife holder 27 with stator tools 26.

Due to the tilting of the support surface 46, an axial movement of support surface 45 is transformed into a radial movement of knife holder 27 and thus stator tools 26. The degree of the tilting as well as the degree of the gear reduction 54 ensure a precise and sensitive resetting possibility of stator tools 26.

Figure 6:
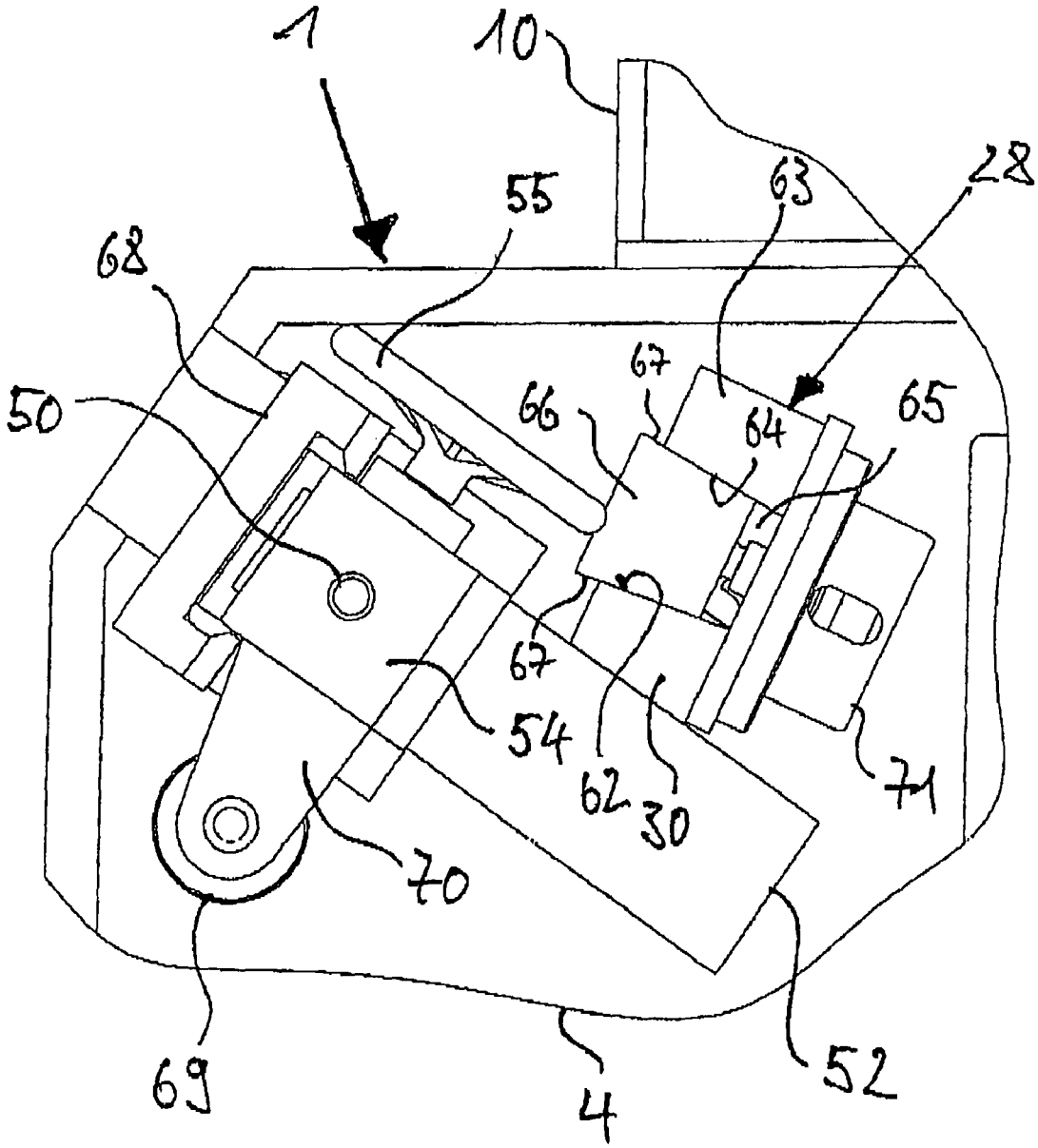
FIG. 6 illustrates a partial view of the clamping device for fixing the stator tools along the Line VI-VI illustrated in FIG. 4.

During the processing of feedstock, stator tools 26 are fixed by clamping device 28, whose closer construction is especially described in FIGS. 5 and 6. Clamping device 28 comprises the already mentioned clamping bars 29 and 30, whereby clamping bar 29 is connected with the interior of front sides 3 and 4. By contrast, clamping bar 30 extends through corresponding openings in front sides 3 and 4 to the area outside housing 1. The end sections of clamping bar 30 lying outside front sides 3 and 4 are respectively beveled to form wedge surface 62. Opposite this wedge surface 52, a pillow block bearing 63 can be seen that is firmly fastened to the outside of front sides 3 and 4. The pillow block bearing 63 likewise has a wedge surface 64, which encloses a conically running interstice 65 with support surface 63 of clamping bar 30. In interstice 54, a spring-loaded clamping wedge 66 is extended with wedge surface 67 running in the opposite direction to wedge surfaces 62 and 63. As a result of the spring loading, clamping wedge 66 is persistently pressed into interstice 65, whereby a laterally acting compressive force produced by the clamping effect of clamping bar 31 is exerted on clamping bar 31. The releasing of the clamping is produced by a force against the pre-loaded spring, which, for example, may be applied by a cylinder piston device 71.

In addition, the invention is characterized by the possibility of a simple and quick change of stator tool 26. As is apparent in FIGS. 1, 2, and 4, a continuation of linear guide 36 has been found for this purpose, by arranging an aligned linear guide 68 of identical construction on the outside of housing 1. Since the lower edge of opening 53 is flush with the floor of slot 37, it is possible, after the release of the insert 52, to pull slide 38, including knife holder 27 with stator tools 26, through the emptying hole 52, axially outwards.

As can be seen in FIG. 4, a cylinder piston device 69 is provided for this purpose, whose cylinder is fastened to front side 3 and/or 4, while its moveable piston passes through an opening in front side 4 where it is connected rigidly to the connection plate 70 fastened to insert 52. As an alternative to the cylinder piston device 69, a rack and pinion drive is also possible, for example, whose resulting force parallel to guide 36 and 68 is applied as close as possible to slide 38. For example, the rack and pinion can be constructed from the underside of base plate 39.

In order to change stator tools 26, first clamping wedge 66 must be removed from both ends of clamping bar 30. The resulting initial slight sideward movement of clamping bar releases knife holder 27. Actuating handwheel 55 produces a lowering of stator tools 26 until their active edges 56 are no longer in contact with processing tools 24. After the release of insert 52 and the deployment of the cylinder piston device 69, the entire subassembly, consisting of base plate 39, wedges 40 and 41 as well as knife holder 27 with supports 58 and 59 including stator tools 26 are slid through the emptying opening 53 outwards into the area of linear guide 68. Stops 57 at the base of longitudinal slots 47 and 48 serve as actuators for knife holders 27. In linear guides 68 outside housing 1, stator tools 26 are easily accessible for their removal from knife holder 27. After exchanging stator tools 26 for unused ones, the new stator tools are inserted in the reverse order in the processing position and are attached in this position by means of clamping bar 28 after the setting of the working clearance 35.

FIGS. 7, 8, 9 and 10 show further embodiments of the invention for the radial positioning of stator tools 26. The same reference numbers used in the previously described embodiments are used for the same characteristics below.

Figure 7:
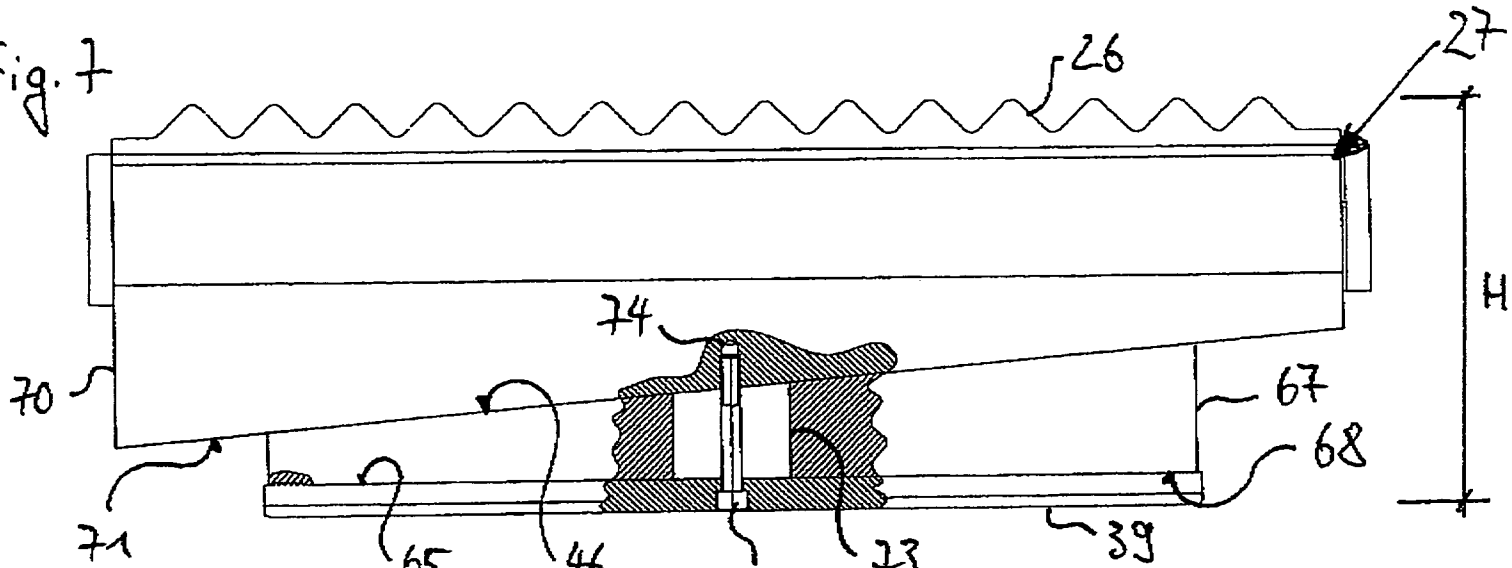
FIGS. 7-9 illustrate various views of further embodiments of the resetting device.
Figures 9, 10:
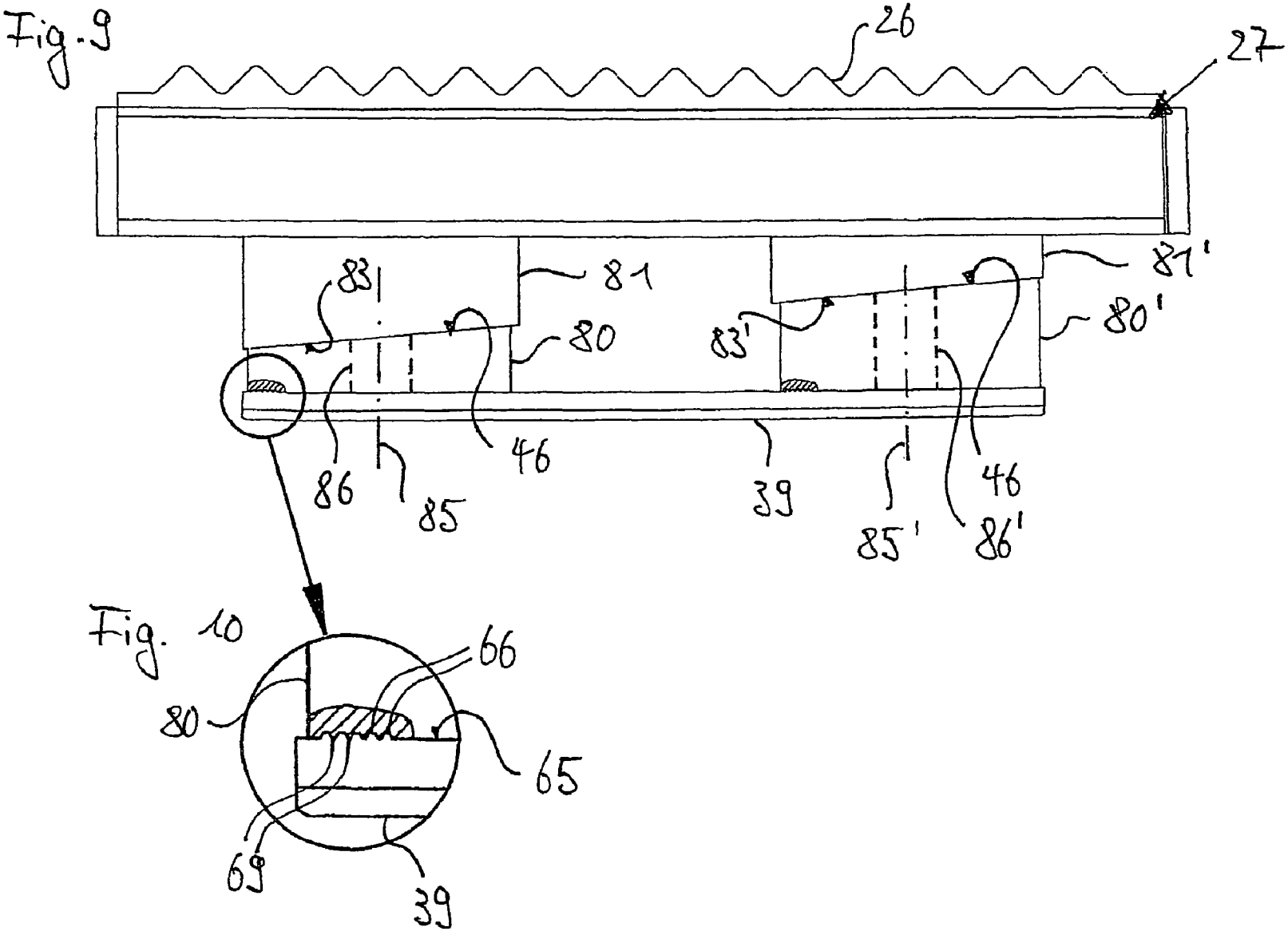
FIG. 10 is a detailed view of the resetting device illustrated in FIG. 9.

In FIG. 7, base plate 39 can initially be seen, which is housed in a device of linear guide 36 (FIG. 4) according to the invention. The topside 65 of base plate 39 is provided with transversal profiles that may be rounded or pointed (FIG. 10). A wedge 67 sits on base plate 39 with its basic surface loose. The basic surface 68 likewise has profiles 69 that are formed complementary to the profiles 66 of base plate 39. The topside of wedge 67 opposite to the basic surface 68 forms setup surface 46.

Support surface 46 carries a knife holder 27 with a trough-shaped housing for stator tools 26. A wedge-shaped boss 70 is moulded on the underside of knife holder 27 over the entire length in one piece. The tilted underside 71 of the wedge-shaped boss 70 forms a contact joint with support surface 46, whereby it is also possible to provide this contact joint with complementary profiles.

The components described form a stator package or a subassembly that is held together with a radial tensioning screw 72. The radial tensioning screw 72 extends from base plate 39 through wedge 67, which has an axially oriented slot hole 73 in a tap hole 74 in the wedge-shaped boss 70 of knife holder 27.

The insertion of stator tools 27 is carried out by presetting the installation height H of the stator package, for which purpose tensioning screw 72 is released and wedge 67 is axially displaced within the framework of the play relative to the wedge-shaped boss 70 provided by slot hole 73 and base plate 39, whereby the installation height H is changed as a function of the direction and mass of the sliding movement.

After the presetting of the desired installation height H, the tensioning screw 72 is energized, whereby profiles 66 and 70 and if necessary, the profiles in the contact joint between wedge 67 and boss 70 are solidly interlocked. A stator package thus preset can then be inserted in linear guide bearing 36, whereby the stator tools 26 can immediately reach its required position.

Figure 8:
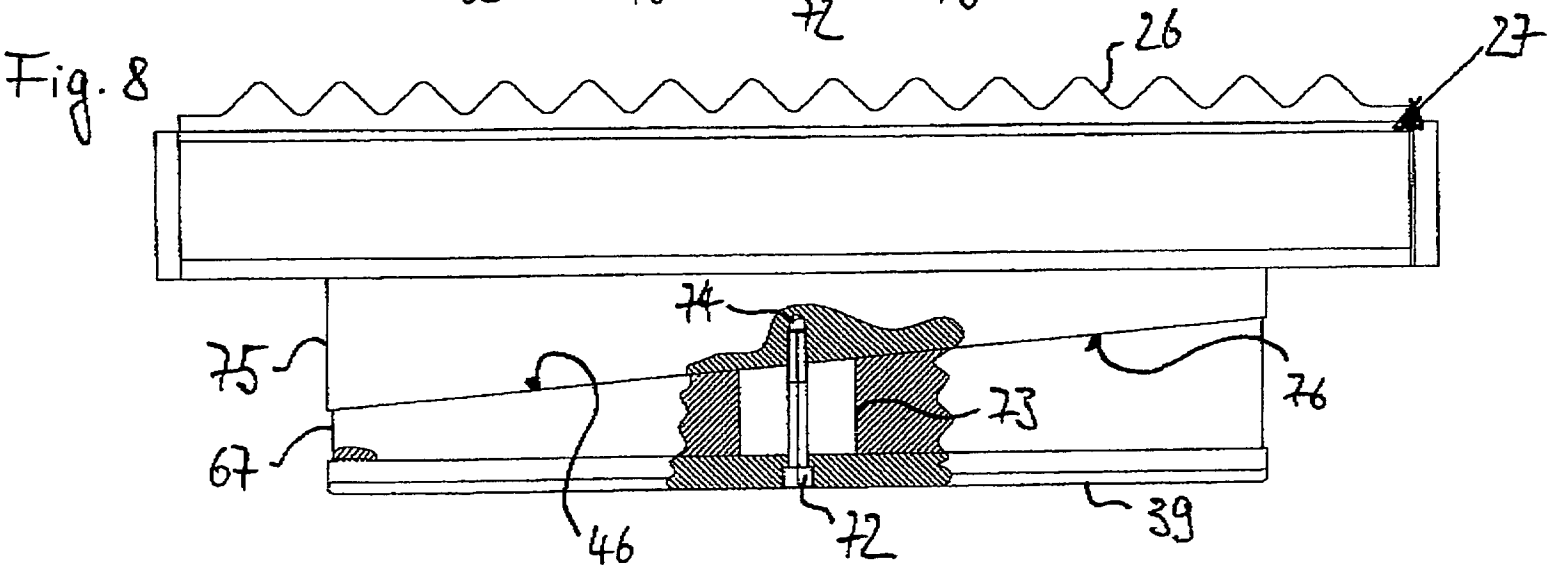

The embodiment illustrated in FIG. 8 corresponds as far possible to that already described in FIG. 7, so that what was said at that point applies analogously. The difference consists simply that, instead of the wedge-shaped boss 70, which is connected in one piece with stator tool 27, a counter blade 75 is welded or screwed to the underside of stator tool 27. The wedge surface 76 interacting with support surface 46 of wedge 67 corresponds to the tilted underside 71 of boss 70. The embodiment in FIG. 8 is otherwise identical to the embodiment described in FIG. 7.

The embodiment of a resetting device described in FIG. 9 comprises two wedges 80 and 80', whose construction is similar to the wedge 67 described in FIGS. 7 and 8, only that the wedges 80 and 80' are substantially shorter in the axial direction. Each 80, 80' wedge sits loose on base plate 39, whereby the contract surface can be formed in turn with complementary profiles 66, 69 (FIG. 10). Support surface 46 is formed from the two topsides of wedge 80, 80', on which the counter wedges 81 and 81' in turn rest with their tilted undersides 83, 83'. The counter wedges 81 and 81' are again connected with the underside of stator tool 27, in which stator tools 26 are finally housed. The stator package is simply held together with the tensioning screws indicated in line 85, 85', which run within slot holes 86, 86'.

The embodiments of the invention illustrated in FIGS. 7 to 10 are particularly suitable for the manual removal of the stator packages for replacement out of the housing 1 or for a radial resetting. With these embodiments, the setting of the installation height of the stator packages to a predetermined size can be carried out outside the device, which appears advantageous with respect to the changing of the stator tools 26. These embodiments are especially distinguished in an economic aspect due to their lower construction expense.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A device for processing feedstock, the device comprising:

a rotor rotating around an axis in a housing, which houses processing tools, and has stator tools that are stationary with respect to the housing, which, by maintaining a working clearance, the rotor side processing tools are arranged opposite to the stator tools and interact with the stator tools to process the feedstock; and a resetting device for displacing the stator tools in a radial direction to set the working clearance, the resetting device for the stator tools having at least one tilted support surface, which directly or indirectly forms a contact surface for the stator tools, wherein the support surface is slideable with respect to the stator tools in order to adjust the working clearance, wherein the support surfaces of the wedge surfaces are constructed of one or more wedge components on which the stator tools directly or indirectly rest, and wherein a plurality of wedge components forming the support surface are arranged on a joint base plate, which is slideably positioned in a guide for the support surface.

2. The device according to claim 1, wherein the stator tools are held laterally directly or indirectly between two clamping bars.

3. The device according to claim 2, wherein one bar is stationary and the other bar is provided with a clamping device for fixing the stator tools.

4. The device according to claim 1, wherein the resetting device comprises a linear guide for conducting a linear relative displacement of the support surface.

5. The device according to claim 4, further comprising a drive for the relative displacement comprises a worm gear, a rack and pinion drive, or a hydraulic drive.

6. The device according to claim 4, wherein the linear relative displacement is an axial relative displacement.

7. The device according to claim 4, wherein the support surface has a guide in which the stator tool is guided directly or indirectly during the relative displacement.

8. The device according to claim 7, wherein the support surface has a slot, and wherein an engaging part is complementarily formed for the direct or indirect positioning of the stator tool.

9. The device according to claim 1, wherein the stator tools are arranged on supports, which are supported via the support surface.

10. The device according to claim 1, wherein front sides of the housing form an axial bearing for the stator tools during relative displacement thereof.

11. The device according to claim 1, wherein a linear guide extends outside of the housing by the arrangement of an aligned guide.

12. The device according to claim 1, wherein the stator tools are each arranged in a knife holder whose underside interacts with the support surface for a radial displacement of the stator tools.

13. The device according to claim 12, wherein a wedge-shaped boss is attached in one piece or detachable, whose tilted underside forms a contact surface with the support surface.

14. The device according to claim 1, wherein the support surface of the tilted topside is constructed of at least one wedge, which is clamped in a predetermined axial position opposite the stator tools or the knife holder by fasteners against the stator tools or the knife holder.

15. The device according to claim 14, wherein the wedges are loosely arranged between the base plate and the contact surface of the knife holder or the stator tools, and wherein the fasteners extend from the base plate to the stator tools or the knife holder for fixation of the wedges.

16. The device according to claim 14, wherein the wedge or wedges each have a slot hole, which extends from the support surface to the opposite wedge side and in which the fasteners are arranged.

17. The device according to claim 14, wherein the contact surface is provided with complementary profiles between the base plate and the wedge or wedges.

18. The device according to claim 14, wherein the contact surface in the area of the support surface is provided with complementary profiles.

19. A device for processing feedstock, the device comprising:

a rotor rotating around an axis in a housing, which houses processing tools, and has stator tools that are stationary with respect to the housing, which, by maintaining a working clearance, the rotor side processing tools are arranged opposite to the stator tools and interact with the stator tools to process the feedstock; and a resetting device for displacing the stator tools in a radial direction to set the working clearance, the resetting device for the stator tools having at least one tilted support surface, which directly or indirectly forms a contact surface for the stator tools, wherein the support surface is slideable with respect to the stator tools in order to adjust the working clearance, wherein the stator tools and the support surface form a subassembly that is removable from the housing along a guide for the support surface.

20. The device according to claim 19, wherein the subassembly can be pushed out of the housing by a drive.

21. The device according to claim 20, wherein the drive is a cylinder piston device.

* * * * *